United States Patent [19]

Shanks

[11] 4,341,514

[45] Jul. 27, 1982

[54] STANDOFF FOR TWO COMPONENT LINING AND METHOD OF INSTALLATION

[76] Inventor: Douglas G. Shanks, P.O. Box 1195, Dunedin, Fla. 33528

[21] Appl. No.: 210,415

[22] Filed: Nov. 25, 1980

[51] Int. Cl.[3] ..... F27D 1/16

[52] U.S. Cl. ..... 432/3; 110/336; 264/30; 432/119

[58] Field of Search ..... 432/119, 247, 251, 3; 264/30; 110/336

[56] References Cited

U.S. PATENT DOCUMENTS 3,993,433 11/1976 Isaksson et al. ..... 432/247

FOREIGN PATENT DOCUMENTS 1814463 8/1970 Fed. Rep. of Germany ..... 110/336

AD6548 of 1904 United Kingdom ..... 110/336

*Primary Examiner*—John J. Camby

*Attorney, Agent, or Firm*—Frijouf, Rust & Pyle

[57] ABSTRACT

An apparatus is disclosed for securing a two component lining to the inside shell of a rotary kiln or the like. The apparatus includes a plurality of standoffs each having a bottom portion for connection to the inside shell of the kiln, a middle portion, and a top portion. A grid is connected to each of the top portions by means of a weld. A layer of a lightweight first castable material having high insulative properties is gunned or cast along the inside shell of the kiln to a depth less than the height of the standoffs. A second castable material having abrasion resistive properties is gunned or cast onto the surface of the first castable material at a depth substantially level with the surface of the grid. The standoffs serve as an anchor to secure the two layers of castible material into position . The grid connected to the top portion of the standoffs is preferably a honeycomb grid which aids the second castable material in protecting the first castable material from damage due to abrasion.

12 Claims, 5 Drawing Figures

STANDOFF FOR TWO COMPONENT LINING AND METHOD OF INSTALLATION

BACKGROUND OF THE INVENTION

1. Field of the Invention

This invention relates to two component linings for a rotary kiln or the like. More particularly, this invention relates to an apparatus for connecting a two component lining to the inside shell of a kiln.

2. Description of the Prior Art

It is well known that a rotary kiln is presently the most efficient means for drying a large quantity of a product such as lime. Basically, rotary kilns comprise a cylindrical shell which is rotated by a drive mechanism. Heat is applied from the discharge end of the kiln by a burner. A plurality of chains are suspended from the inside shell of the kiln at the product receiving end of the kiln to absorb the heat produced by the burner. As the kiln rotates, the heat absorbed by the chains is transferred to the product being dried. The shell of the kiln is insulated to minimize the conduction of heat loss through the shell of the kiln to increase the overall efficiency of the kiln in drying the product. Moreover, the inside shell of the kiln must be protected from abrasion and wear caused by the plurality of chains and the product during rotation of the kiln.

Various attempts have been made to adequately insulate the shell of the kiln and to protect the shell of the kiln from damage due to abrasion. Primarily, those attempts have included lining the inside shell of the kiln with a refractory material. Unfortunately, few of the state of the art materials have the properties of being able to withstand great amounts of abrasion and simultaneously adequately insulate the shell of the kiln. The refractory materials which do have both of the abovementioned properties are relatively heavy and therefore increase the overall weight of the rotary kiln. Accordingly, an excessive amount of energy must be expended to rotate the kiln during operation.

Therefore it is an object of this invention to provide an apparatus which overcomes the aforementioned inadequacies of the prior art devices and provides an improvement which is a significant contribution to the advancement of the lining art, as applied to rotary kilns and the like.

Another object of this invention is to provide an apparatus for connecting a lightweight first castable material having high insulating properties to the inside shell of a kiln for minimizing the amount of conduction heat loss through the shell of the kiln and for minimizing the amount of energy required to rotate the kiln during operation.

Another object of this invention is to provide an apparatus for connecting a second castable material to the surface of the lightweight first castable material for protecting the first castable material and the inside shell of the kiln from damage due to abrasion during operation of the kiln.

Another object of this invention is to provide an apparatus which includes a standoff for securing the first and second castable materials into position adjacent to the inside shell of the kiln.

Another object of this invention is to provide an apparatus wherein the standoffs are secured longitudinally along the inside shell of the kiln.

Another object of this invention is to provide an apparatus including a grid which is secured to the top portion of the standoff for increasing the overall strength of the second castable material and to aid the second castable material in protecting the first castable material from damage due to abrasion.

Another object of this invention is to provide an apparatus wherein the standoffs have a hollow configuration to minimize the amount of heat loss due to conduction through the standoff to the inside shell of the kiln.

Another object of this invention is to provide an apparatus wherein the standoff has a hollow configuration to act as an expansion joint to permit expansion of the castable material at elevated temperatures thereby preventing the castable materials from fracturing.

Another object of this invention is to provide an apparatus wherein the standoffs include a middle portion which has a width smaller than the width of the top portion thereby acting as an anchor to secure the first and second castable material into position.

Another object of this invention is to provide an apparatus wherein the standoff includes a bottom portion which has a width larger than the middle portion thereby minimizing the occurrence of voids in the first castable material which may occur at the corner formed by the bottom portion and the inside shell of the kiln when the first castable material is gunned or cast into position along the inside shell of the kiln.

Other objects and a fuller understanding of the nature and objects of this invention may be had by referring to the summary of the invention, the description and the claims, taken in conjunction with the accompanying drawings.

SUMMARY OF THE INVENTION

The invention is defined by the appended claims with a specific embodiment shown in the attached drawings. For the purpose of summarizing the invention, the invention comprises an apparatus enabling a two component lining to be secured to the inside shell of a rotary kiln or the like. Specifically, the apparatus includes a plurality of elongated standoffs which are connected longitudinally along the inside shell of the kiln. Each standoff comprises a bottom portion for connection to the inside shell of the kiln, a middle portion, and a top portion. A plurality of grid segments are welded to the top portions of the standoffs. A layer of lightweight first castable material having high insulative properties is gunned or cast into position along the inside shell of the kiln at a depth less than the height of the plurality of standoffs. A second castable material having higher structural strength and strong abrasion resistive properties is gunned or cast onto the layer of the first castable material at a depth substantially level with the height of the grid.

The insulative first castable material insulates the inside shell of the kiln thereby minimizing the amount of conduction heat loss through the shell of the kiln. Additionally, the energy required to rotate the kiln is minimized due to the light weight of the first castable material. The layer of second castable material serves to protect the layer of the first castable material from damage due to abrasion. The incorporation of the honeycomb grid within the layer of the second castable material aids the second castable material in protecting the first castable material from damage due to abrasion.

In the preferred embodiment, the sides of the standoffs are concave inwardly defining a middle portion having a width less than the top portion and the bottom portion. Such a configuration causes the standoffs to act as an anchor to secure the layers of the first and second castable material against the inside shell of the kiln. Moreover, that the bottom portion has a width which is larger than the middle portion decreases the likelihood of voids being defined at the corner formed by the bottom portion and the inside shell of the kiln when the first castable material is gunned or cast into position.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the specific embodiment disclosed may be readily utilized as a basis for modifying or designing other structures for carrying out the same purposes of the present invention. It should be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
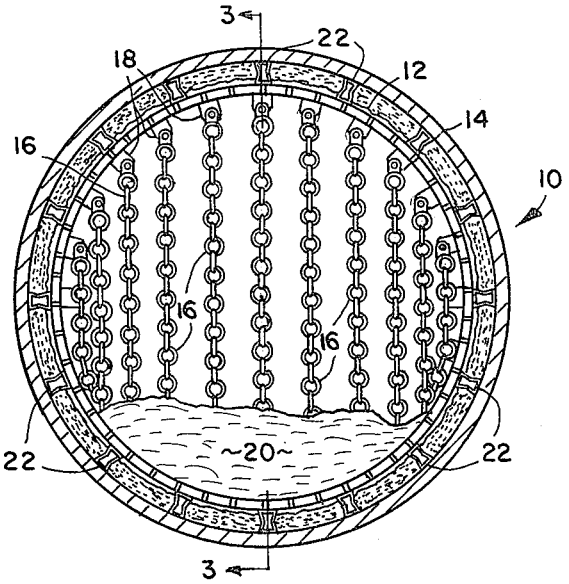
FIG. 1 is a cross-sectional view of a rotary kiln showing the lining of the invention.

FIG. 1 is a cross-sectional view of a rotary kiln 10 showing the two component lining 12 of the invention connected to the inside shell 14 of the kiln 10. In most conventional rotary kilns, heat is applied from a discharge end of the kiln 10 by a burner. The heat is absorbed by a plurality of chains 16 which are suspended from the inside shell 14 of the kiln 10 by means of brackets 18. The heat absorbed by the chains 16 is then transferred to the product 20 being dried as the kiln 10 rotates. The chains 16 also serve as a dust curtain to minimize the amount of dust which is discharged through an exhaust end of the kiln 10.

Figure 2:
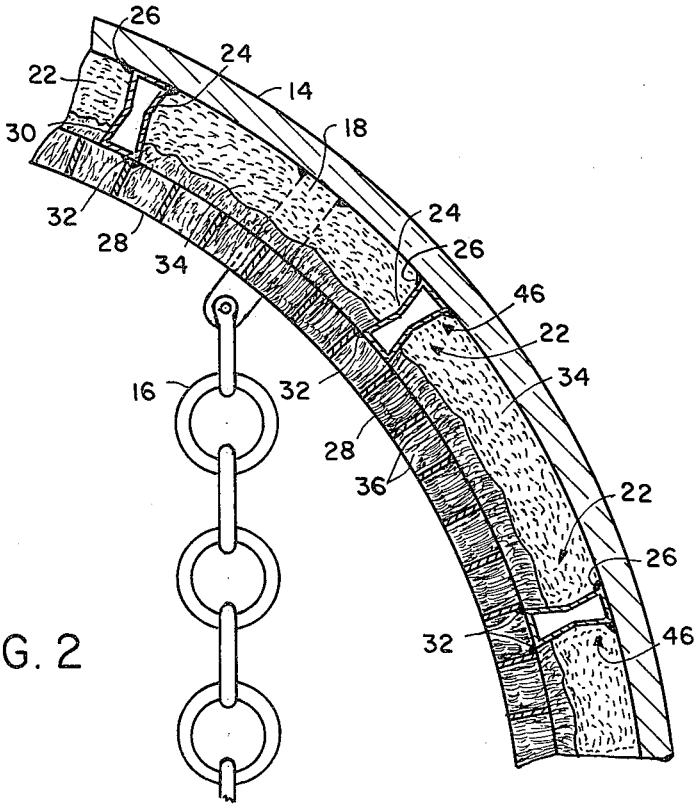
FIG. 2 is an enlarged partial cross-sectional view of a rotary kiln showing the various components of the lining of the invention.

As shown in FIG. 2, the lining 12 of the invention comprises a plurality of elongated standoffs 22 having a bottom portion 24 which is connected to the inside shell 14 of the kiln 10 by means of a weld 26. A plurality of grid segments 28 are connected to a top portion 30 of the standoffs 22 by means of weld 32. Preferably, the plurality of grid segments 28 are connected to the standoffs 22 between each curtain of chains 16. After the standoffs 22 and the grid segments 28 are welded into position, a first castable material 34 is then gunned or cast along the inside shell 14 of the kiln 10. A second castable material 36 is then either gunned or cast over the surface of the first castable material 34.

Figure 3:
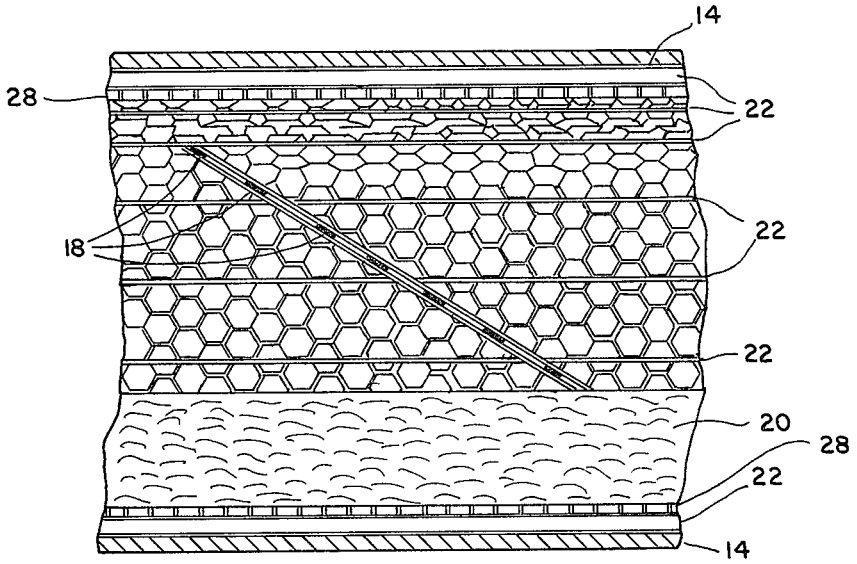
FIG. 3 is a partial cross-sectional view along line 3—3 of FIG. 1 showing the placement of the standoffs and the grid segments within the rotary kiln.

FIG. 3 is a partial cross-sectional view of FIG. 1 along lines 3—3 (chains 16 removed) showing the placement of the plurality of standoffs 22 and the grid segments 28 within the kiln 10. Specifically, a plurality of elongated standoffs 22 are connected longitudinally along a substantial portion of the length of the kiln 10. It should be appreciated that the standoffs 22 are connected to the inside shell 14 of the kiln 10 without interfering with the placement of the brackets 18 which support the curtain of chains 16. Such a feature of this invention is particularly desirable since it enables an operator to install the lining 12 of the invention without having to remove the brackets 18 from the inside shell 14 of the kiln 10. After the plurality of standoffs 22 are welded into position, the plurality of grid segments 28 are then welded to the top portion 30 of the standoffs 22. Since the curtain of chains 16 are generally connected to the inside shell 14 of the kiln 10 in a helical pattern, each grid segment 28 must be formed in a similar helical pattern enabling the grid elements 28 to be installed between individual curtains of chains 16.

It should be appreciated that the plurality of elongated standoffs 22 may be positioned within the inside shell 14 of the kiln 10 in any configuration. For example, the plurality of elongated standoffs 22 may be connected circumventially around the inside shell 14 of the kiln in a circular or a helical pattern rather than longitudinally as shown in FIG. 3. It should also be understood that the plurality of grid segments 28 may be shaped into any configuration depending on the placement of the curtain of chains 16 within the kiln 10. For example, if a plurality of individual curtains of chains 16 are connected transversely across the inside of the kiln 10, the plurality of grid segments 28 should be configured to be positioned between each individual curtain of chains 16.

FIG. 3 also further illustrates the type of grid segments 28 which may be connected to the top portion 30 of the standoffs 22. In the preferred embodiment, each grid segment 28 comprises a honeycomb configuration. The second castable material 36 is gunned or cast onto the surface of the first castable material 34 at a depth level with the surface of the grid segments 28. The honeycomb configuration of the grid segments 28 adds significantly to strengthen the second castable material 36 while also providing a wear surface armor to protect the second castable material 36 from abrasion. It should be understood that the grid segments 28 may comprise other configurations such as a rectangular configuration (not shown) without departing from the spirit and scope of this invention.

Figure 4:
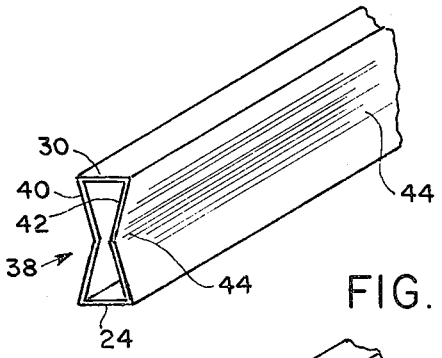
FIG. 4 is a perspective view of a first embodiment of the standoffs.

FIG. 4 illustrates the first embodiment of the standoff 22 of the invention. Specifically, the first embodiment of the standoff 22 comprises a bottom portion 24 for connection to the inside shell 14 of the kiln, a middle portion 38, and a top portion 30 for connection to the grid segments 28. The sides 40 and 42 of the standoff 22 are concave inwardly to define a recess 44 along the length of the standoff 22. The width of the middle portion 38 is therefore smaller than the width of the bottom portion 24 and the top portion 30. Referring again to FIG. 2, when the first castable material 34 is applied to the inside shell 14 of the kiln at a depth less than the height of the standoff 22, the top portion 30 acts as an anchor to secure the first castable material 34 against the inside shell 14 of the kiln 10. The top portion 30 of the standoff 22 also acts as a similar anchor to secure the second castable material 36 against the first castable material 34. It should therefore be appreciated that a novel feature of the first embodiment of the standoff 22 is the fact that the standoff serves as an anchor to secure both the first and second castable materials 34 and 36 into position.

The bottom portion 24 has a width which is larger than the width of the middle portion 38 to eliminate the formation of voids within the first castable material 34 along the corner 46 formed by the bottom portion 24 and the inside shell 14 of the kiln 10 when the first castable material 34 is gunned or cast into position.

Figure 5:
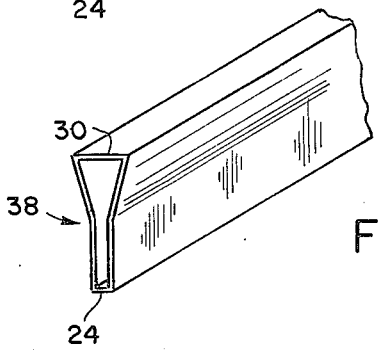
FIG. 5 is a perspective view of a second embodiment of the standoffs of the invention.

FIG. 5 is a perspective view of a second embodiment of the standoff 22 having a middle portion 38 which is narrower in width than the top portion 30. Contrary to the first embodiment to the standoff 22, the second embodiment includes a bottom portion 24 which is substantially equal in width to the middle portion 38. Although the likelihood of the formation of voids in the first castable material 34 at corner 46 is increased when using the second embodiment of the standoff 22, the second embodiment of the standoff 22 may still be suitable in certain applications. For example, the second embodiment of the standoff 22 may be suitable when the first castable material 34 has a relatively low viscosity which enable the corners 46 to be filled by the first castable material 54. Moreover, the reduced cost of manufacturing the second embodiment versus the first embodiment of the standoff 22 may overcome the disadvantages of occasional voids being formed at the corners 46.

As shown in FIGS. 4 and 5, both embodiments of the standoffs have a hollow configuration thereby creating a dead air space between the top portion 30 and the bottom portion 24 of the standoff 22. This dead air space substantially reduces the amount of heat loss by conduction through the standoff 22 to the interior shell 14 of the kiln 10. Moreover, the hollow configuration substantially reduces the overall weight of the standoffs 22 thereby reducing the amount of energy expanded to rotate the kiln 10 during operation. Finally, the hollow configuration substantially reduces the manufacturing cost of producing the standoff 22. The standoffs 22 also act as an expansion joint to permit expansion of the castable materials 34 and 36 at elevated temperatures thereby preventing fracturing of the castable materials 34 and 36.

It should be apparent from the above description that the unique standoff 22 of the invention enables a two component lining to be installed on the interior shell 14 of the kiln 10. The first castable material 34 may comprise a lightweight castable material having strong insulating properties thereby minimizing the amount of conduction heat loss through the shell 14 of the kiln 10 in addition to reducing the amount of energy required to rotate the kiln 10. The second castable material 36 may comprise a severe-service castable material which protects the first castable material 34 from abrasion and damage during operation of the kiln 10.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

Now that the invention has been described:

I claim:

1. An apparatus for securing a two component lining to the inside shell of a kiln to minimize heat loss through the shell of the kiln and to protect the shell of the kiln from abrasion, comprising in combination:

a plurality of elongated standoff means each having a bottom portion and a top portion extending along the entire length of said elongated standoff means;

said length of each of said elongated standoff means being substantially greater than the distance between said bottom portion and said top portion;

means for securing the bottom portion of each of said plurality of standoff means to the inside shell of the kiln for continuously extending the entire dimension of the kiln in a direction along the length of said elongated standoff means;

a first castable material disposed adjacent the inside shell of the kiln at a thickness less than said top portion of said standoff means;

a grid secured to said top portion of said standoff means; and a second castable material disposed upon said first castable material and secured thereto by said grid for protecting said first castable material.

2. The apparatus as set forth in claim 1, wherein said first castable material comprises an insulative castable material for substantially reducing conduction heat loss through the shell of the kiln.

3. The apparatus as set forth in claim 2, wherein said second castable material is a severe-service castable material for protecting said first castable material from abrasion and for protecting the inside shell of the kiln from abrasion during operation of the kiln.

4. The apparatus as set forth in claim 1, wherein said means for securing said bottom portion of said standoff means to the inside shell of the kiln includes welding.

5. The apparatus as set forth in claim 4, wherein said grid is secured to said top portions of said standoff means by welding.

6. The apparatus as set forth in claim 1, wherein each of said bottom portions has a width larger than said middle portion to reduce the formation of voids at the corners defined by said bottom portion and the inside shell of the kiln when said first castable material is applied to the inside shell of the kiln.

7. The apparatus as set forth in claim 6, wherein the sides of each of said standoff means is concaved inwardly whereby said middle portion has a width less than the width of said top portion and said bottom portion for facilitating the application of the first castable material to the inside shell of the kiln.

8. The apparatus as set forth in claim 7, wherein the sides of said middle portion of said standoffs are concaved inwardly to define a recess point located at the midsection of said middle portion for facilitating the application of the first castable material to the inside shell of the kiln.

9. The apparatus as set forth in claim 1, wherein each of said standoff means is a hollow configuration to minimize conduction heat loss through said standoff means to the shell of the kiln.

10. The apparatus as set forth in claim 1, wherein said grid comprises a honeycomb grid connected to said top portions for holding said second castable material in position and for at least partially protecting the surface of said second castable material from abrasion during operation of the kiln.

11. The apparatus as set forth in claim 1, wherein said plurality of standoff means are connected longitudinally along the substantial length of the kiln.

12. The method of applying a two component lining to the inside shell of a kiln, comprising the steps of:

welding a plurality of elongated standoffs to the inside shell of the kiln to form a substantially parallel array of the elongated standoffs extending the entire length of the kiln;

applying a first castable material having high insulative properties to the inside shell of the kiln to a thickness insufficient to cover the plurality of elongated standoffs;

welding a grid to the exposed portions of the plurality of elongated standoffs; and applying a second castable material having a high resistance to abrasion upon the first castable material to a thickness commensurate with the level of the grid.

* * * * *